US012421813B2

(12) United States Patent
Valentine et al.

(10) Patent No.: US 12,421,813 B2
(45) Date of Patent: Sep. 23, 2025

(54) OVERHEAD ROBOT TRACK APPARATUS AND METHODS RELATED TO SAME FOR RIGS

(71) Applicant: Helmerich & Payne, Inc., Tulsa, OK (US)

(72) Inventors: Brandon D. Valentine, Bixby, OK (US); Todd R. Woods, Perry, OK (US); Andrew Rose, Tulsa, OK (US); Michael Brzezniak, Cypress, TX (US); Trevor Hall, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 18/667,688

(22) Filed: May 17, 2024

(65) Prior Publication Data

US 2024/0384611 A1 Nov. 21, 2024

Related U.S. Application Data

(60) Provisional application No. 63/502,969, filed on May 18, 2023.

(51) Int. Cl.
*E21B 19/08* (2006.01)
*E21B 15/00* (2006.01)

(52) U.S. Cl.
CPC ..... *E21B 19/08* (2013.01); *E21B 15/00* (2013.01)

(58) Field of Classification Search
CPC ..... E21B 19/08; E21B 15/00; E21B 19/155
See application file for complete search history.

(56) References Cited

U.S. PATENT DOCUMENTS

2021/0054700 A1 2/2021 Basile et al.
2021/0301602 A1* 9/2021 Mckenzie ..... E21B 41/04
2022/0178215 A1 6/2022 Donnally et al.

FOREIGN PATENT DOCUMENTS

CA 3209220 A1 8/2022
CN 108999579 A * 12/2018 ..... E21B 19/00

OTHER PUBLICATIONS

PCT/US2024/030104, "International Search Report and Written Opinion", Jul. 26, 2024, 13 pages.

* cited by examiner

*Primary Examiner* — James G Sayre
(74) *Attorney, Agent, or Firm* — Kilpatrick Townsend & Stockton LLP

(57) ABSTRACT

A drilling rig assembly includes a robot system further including a robot and a robot track for movement of a position of the robot and a frame assembly couplable to a drilling rig for positioning the robot system above a floor of the drilling rig. The frame assembly includes a first support pillar extending upwardly from a floor of the drilling rig, a horizontal track support coupled to the robot track and coupled to the first support pillar, and a cantilever support extending between the first support pillar and the horizontal track support. The robot track includes a plurality of rails that couple to the robot such that the robot may move along a length of the robot track. Benefits of elevating a robot of a robot system off the drilling rig floor include minimizing the risk of injuries and providing additional open floor space on the drilling rig.

20 Claims, 5 Drawing Sheets

OVERHEAD ROBOT TRACK APPARATUS AND METHODS RELATED TO SAME FOR RIGS

CROSS-REFERENCE TO RELATED APPLICATIONS

This application claims the benefit of priority to U.S. Provisional Patent Application No. 63/502,969, filed May 18, 2023, and entitled "Overhead Robot Track Apparatus For Rigs," the contents of which are hereby incorporated by reference in their entirety for all purposes. This application also cross-references to U.S. patent application Ser. No. 18/592,060, filed Feb. 29, 2024, entitled "Method and Apparatus for Moving Tubular Rotary Slips," the entirety of which is incorporated herein by reference.

FIELD OF THE INVENTION

The present invention relates to the use of robot systems, including but not limited to systems, methods, apparatuses, and assemblies for elevating a robot above a rig floor for a drilling rig and using such robot systems for wellbore drilling operations.

SUMMARY OF THE INVENTION

The present invention relates to apparatus and assemblies for elevating a robot above a rig floor for a drilling rig. Drilling rigs for drilling wellbores may include at least one or more mud tanks and pumps, a derrick, a drawworks, a rotary table, a drill string, power generation equipment, and other equipment. A derrick of a drilling rig may include a framework or tower of wood or steel that is erected over the deep drill holes of oil wells to support the tackle for boring, to raise and lower the drilling tools in the well, and to insert and remove the well casing or pipe. Space on the rig is at a premium due to the all the equipment for drilling the wellbore. Accordingly, the present invention provides a means for using a robot for a drilling rig while minimizing the valuable rig space.

According to one embodiment, a drilling rig assembly includes a robot system further including a robot and a robot track for movement of a position of the robot and a frame assembly couplable to a drilling rig for positioning the robot system above a floor of the drilling rig. The frame assembly includes a first support pillar extending upwardly from a floor of the drilling rig, a horizontal track support coupled to the robot track and coupled to the first support pillar, and a cantilever support extending between the first support pillar and the horizontal track support. The robot track includes a plurality of rails that couple to the robot such that the robot may move along a length of the robot track.

The drilling rig assembly may include various optional embodiments. The first support pillar may include a pair of posts and one or more horizontal members extending between the pair of posts. The robot of the robot system may include an arm for gripping a tubular. The horizontal track support may extend beyond the first support pillar. The cantilever support may extend between the first support pillar and a region of the horizontal track support positioned proximate to a wellbore. The first support pillar may extend vertically upwards from the floor of the drilling rig. The frame assembly may further include a second support pillar extending upwardly from the floor of the drilling rig.

According to another embodiment, an overhead robot track apparatus includes a frame assembly couplable to a drilling rig for positioning a robot above a floor of the drilling rig. The frame assembly includes a first vertical support pillar, a second vertical support pillar, a horizontal track support sized and shaped to couple to a robot track, the horizontal track support coupled to each of the first vertical support pillar and the second vertical support pillar, and at least one cantilever support extending between the first vertical support pillar and the horizontal track support. Each of the first vertical support pillar and second vertical support pillar include a base portion that is removably couplable to an upper portion.

The overhead robot track apparatus may include various optional embodiments. The first vertical support pillar may include a pair of posts and one or more horizontal members extending between the pair of posts. The horizontal track support may be elevated at a height above the rig floor but lower than a racking board of the drilling rig. The horizontal track support may extend beyond at least one of the first vertical support pillar and the second vertical support pillar. The at least one cantilever support may extend between a portion of the horizontal track support that extends beyond the at least one of the first vertical support pillar and the second vertical support pillar. The horizontal track support may be removably couplable to a mast of the drilling rig. The base portion may be secured to a support structure and to the drilling rig. The support structure may include one or more of an I-beam, an H-beam, a channel beam, a square tubing, a round tubing, a rectangular tubing or other suitable support structures. The first vertical support pillar may extend at least 5 feet above the floor of the drilling rig.

According to another embodiment, a method for handling a pipe on a drilling rig includes providing a robot having an arm to removably grasp and release a piece of pipe where the robot is coupled to a robot track for movement of the robot and providing an assembly for elevating the robot and the robot track above a floor of the drilling rig. The assembly includes a first support pillar extending upwardly from a floor of the drilling rig, a second support pillar extending upwardly from the floor of the drilling rig, a horizontal track support coupled to the robot track and coupled to the first support pillar and the second support pillar, and a cantilever support extending between the first support pillar and the horizontal track support. The method includes positioning the robot along the robot track at a first position over an upper section of drill pipe, extending the arm of the robot toward the upper section of drill pipe, grasping the upper section of drill pipe, translating the robot and the upper section of drill pipe along the robot track to a second position over a lower section of drill pipe, and releasing the upper section of drill pipe at the second position for making up a drill pipe.

The method may include various optional embodiments. The horizontal track support may be removably couplable to a mast of the drilling rig. The horizontal track support may be elevated at a height above the rig floor but lower than a racking board of the drilling rig. The horizontal track support may extend beyond at least one of the first support pillar and the second support pillar. The cantilever support may extend between the first support pillar and a region of the horizontal track support positioned proximate to a wellbore.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

BACKGROUND OF THE INVENTION

Figure 1A:
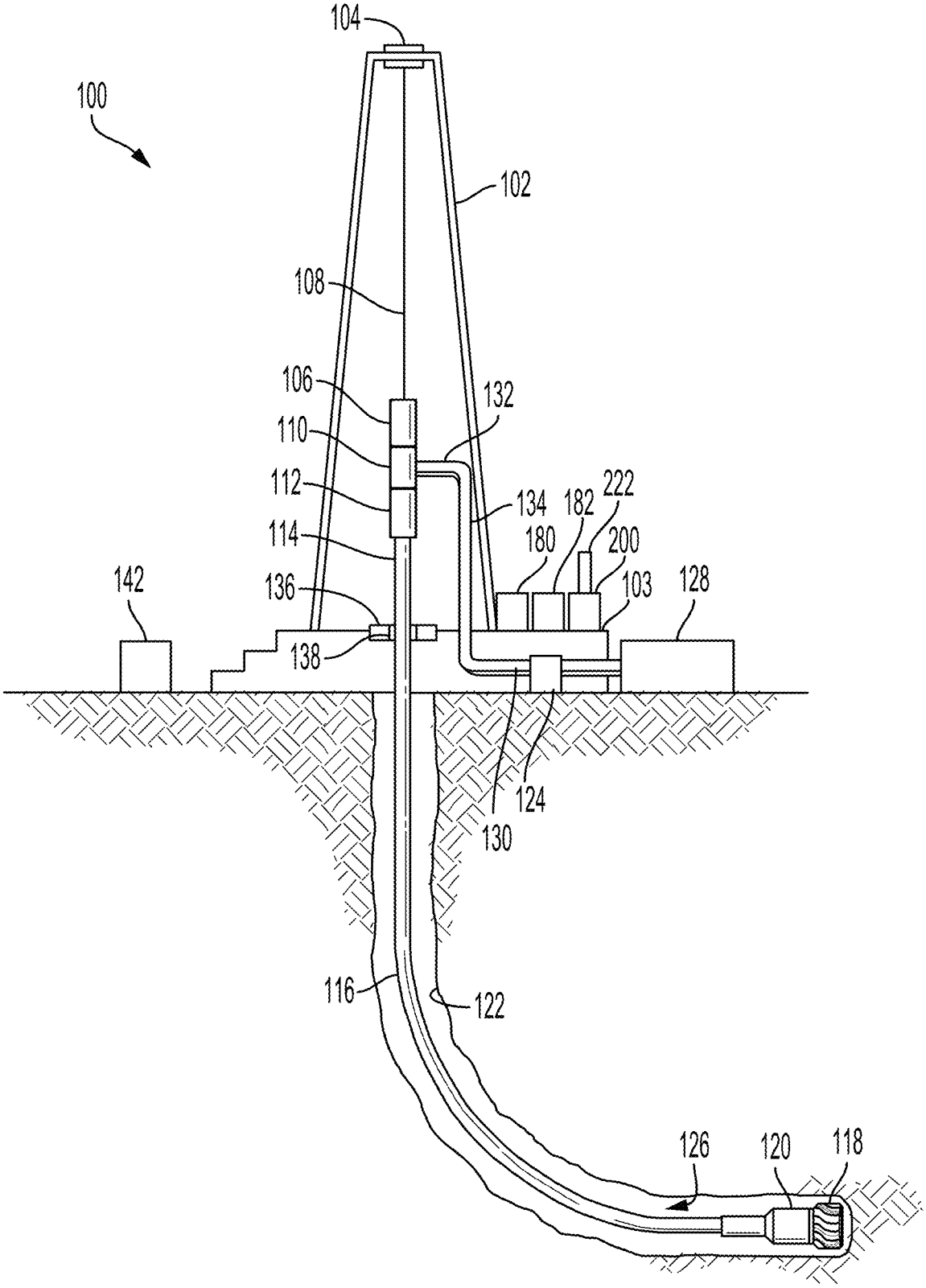
FIG. 1A illustrates one embodiment of a drilling system, in accordance with some embodiments of the present disclosure.

Robot systems have become more commonly used during drilling of a wellbore. For example, robot systems may utilize robots on the drilling floor of rigs, such as for aiding in handling sections of pipe. For example, robot systems may be used to aid in tripping in and/or tripping out drill string for example, by lifting and moving sections of pipe from one location to another on a drilling rig floor. Examples of such robot systems are described in WO 2020/160440 to Donnally et al., and U.S. Pat. No. 10,053,934 to Keogh et al., each of which is hereby incorporated by reference as if fully set forth herein. While the use of robot systems can decrease the risk of injuries to workers who would otherwise be handling pipe sections manually, the use of robot systems can take up valuable rig space. In addition, robot systems may become damaged due to collisions between pipe sections or other heavy equipment and the robot on the rig floor due to the close proximity of equipment on the rig floor. In addition, pipe sections can be quite long and a robot's position on the rig floor may limit how far the robot system can extend or reach to contact and secure itself to a pipe section. Furthermore, the placement and movement of a robot system on the rig floor may create new risks for injuries to workers on the rig. Therefore, it may be desirable to position one or more robots or a robot system relative to the rig floor to reduce the risk of collision or injuries to workers while also improving the robot's reach and/or overall function.

DETAILED DESCRIPTION OF THE INVENTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Robot systems may be used on drilling floor rigs for various reasons such as transporting or otherwise handling sections of pipe or other relatively heavy equipment or components. Robot systems are often desired on drilling rig floors as robot systems often decrease accidents involving workers on the drilling floor rigs who would otherwise be handling pipe sections or the like. However, robot systems used for these purposes take up valuable rig space and may become easily damaged by other equipment, for example, due to the close proximity of equipment (including other robot systems) on the rig floor. In some embodiments, a robot of a robot system may also have limited reach or extension ability when positioned on the rig floor. Accordingly, various embodiments of the present disclosure minimize the risks of injuries and provide improved reaching ability for a robot system as well as reducing the likelihood of damage to the equipment of the robot system, for example including the robot. At least some embodiments of the present disclosure provide for an overhead robot track apparatus that may maintain the ability of the drilling rig to be moved, while minimizing the likelihood of damage to the robot and/or injuries to workers and, in at least some embodiments, may also improve the reach of the robot.

Benefits of elevating a robot of a robot system off the drilling rig floor include minimizing the risk of injuries and providing additional open floor space on the drilling rig, as well as reducing the likelihood that the robot system, including for example the robot, is damaged due to collisions with heavy machinery or pipe sections. In addition, by elevating the robot off the rig floor the robot may have an extended reach for coupling/securing to a pipe section. For example, a robot elevated off the rig floor by an overhead robot track apparatus may be positioned such that it may grab onto an angled pipe closer to the derrick with a shorter reach than if the robot was located at a lower position closer to or on the drilling rig floor. The overhead robot track apparatus of the present disclosure may, in some embodiments, be easily broken down and stowed to allow for the drilling rig to be moved. In some embodiments, a frame of the overhead robot track of the apparatus may be broken down such that no remaining assembled parts exceed height or other requirements for the rig's movement and transportation. In various embodiments, the robot system may be elevated above the rig floor but positioned below (or lower than) than the position of a racking board of the drilling rig. For example, the robot system, or portions thereof, may be elevated to a height location between the rig floor and the racking board to reduce rig real estate occupied by the system.

An overhead robot track apparatus according to some embodiments of the present disclosure may include a frame assembly having at least one vertical support pillar extending upwardly relative to the rig floor. In embodiments in which two or more vertical support pillars are included the pillars may extend upwardly relative to or from the rig floor at a suitable distance from one another. A horizontal track support may extend between the two vertical support pillars and may extend beyond an end of at least one vertical support pillar. A robot track may be coupled to the horizontal track support, for example but not limited to by bolting the robot track to the horizontal track support, though any suitable coupling means may be used (e.g., mechanical fasteners (e.g., screws, bolts, welding, etc.), adhesives (glue, etc.), chemical bonding, or other suitable means). The robot track may provide a rail or a pair of rails upon which the robot may move (e.g., forwards, and backwards along the rails). Each vertical support pillar may comprise a single column, or in some embodiments, may include a plurality of columns. The apparatus may also include one or more cantilever supports which may extend between at least one vertical support pillar and the horizontal track support. The cantilever support(s) may provide support for the weight of the robot on the horizontal track support, for example at least one cantilever support may extend between a vertical support pillar and a proximate end (closest to the wellbore) of the horizontal track support for providing support when the robot is positioned at the proximate end of the horizontal track. It should be noted that additional cross-bracing may be provided if desired, although not shown in the figures.

Referring to FIG. 1A, an embodiment of a drilling environment 100 is provided. Although the environment 100 is a drilling environment that is described with a top drive drilling system, it is understood that other embodiments may include other drilling systems, such as rotary table systems.

In the present example, the environment 100 includes a derrick 102 on a drilling rig 103. The derrick 102 includes a crown block 104. A traveling block 106 is coupled to the crown block 104 via a drilling line 108. In a top drive system (as illustrated), a top drive 110 is coupled to the traveling block 106 and provides the rotational force needed for drilling. A saver sub 112 may sit between the top drive 110 and a drill pipe 114 that is part of a drillstring 116. The top drive 110 rotates the drillstring 116 via the saver sub 112, which in turn rotates a drill bit 118 of a BHA 120 in a borehole 122 in a formation. A mud pump 124 may direct a fluid mixture (e.g., mud) 126 from a mud pit or other container 128 into the borehole 122. The mud 126 may flow from the mud pump 124 into a discharge line 130 that is coupled to a rotary hose 132 by a standpipe 134. The rotary hose 132 is coupled to the top drive 110, which includes a passage for the mud 126 to flow into the drillstring 116 and the borehole 122. A rotary table 136 may be fitted with a master bushing 138 to hold the drillstring 116 when the drillstring is not rotating.

According to various embodiments, the drilling rig 103 may include various components such as a drawworks 180, power generation equipment 182, and any other auxiliary equipment (not shown). The drilling rig 103 may further include an overhead robot track apparatus 200 including a robot 222, to be described in further detail below at least with respect to FIGS. 2-4.

Some or all of a control system 142 may be located at the derrick 102, may be downhole, and/or may be remote from the actual drilling location. For example, the control system 142 may be a system such as is disclosed in U.S. Pat. No. 8,210,283 entitled System and Method for Surface Steerable Drilling, filed on Dec. 22, 2011, and issued on Jul. 3, 2012, which is hereby incorporated by reference in its entirety. Alternatively, the control system 142 may be a standalone system or may be incorporated into other systems at the derrick 102. The control system 142 may communicate via a wired and/or wireless connection (not shown).

Figure 1B:
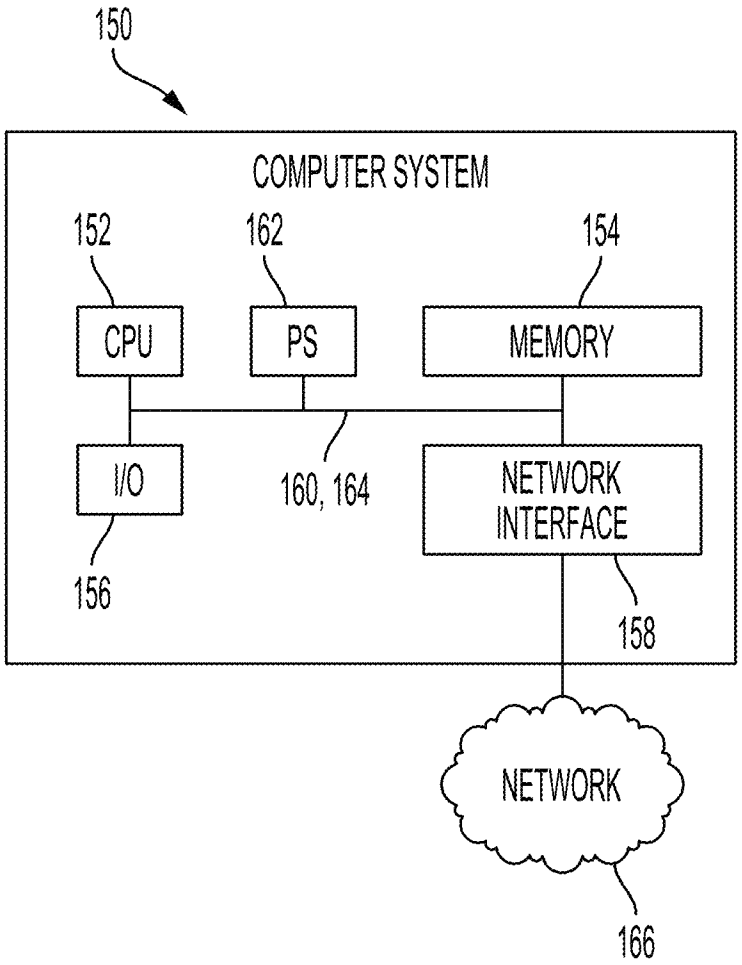
FIG. 1B illustrates one embodiment of a computer system or controller that may be used within the environment of FIG. 1A, in accordance with some embodiments of the present disclosure.

Referring to FIG. 1B, one embodiment of a computer system (or controller or control system) 150 is illustrated. The computer system 150 is one possible example of a system component or device such as the control system 142 of FIG. 1A or a separate system used to perform the various processes described herein. In scenarios where the computer system 150 is on-site, such as within the environment 100 of FIG. 1A, the computer system may be contained in a relatively rugged, shock-resistant case that is hardened for industrial applications and harsh environments. It is understood that downhole electronics may be mounted in an adaptive suspension system that uses active dampening as described in various embodiments herein.

The computer system 150 may include a central processing unit ("CPU") 152, a memory unit 154, an input/output ("I/O") device 156, and a network interface 158. The components 152, 154, 156, and 158 are interconnected by a transport system (e.g., a bus) 160. A power supply (PS) 162 may provide power to components of the computer system 150 via a power transport system 164 (shown with data transport system 160, although the power and data transport systems may be separate).

It is understood that the computer system 150 may be differently configured and that each of the listed components may actually represent several different components. For example, the CPU 152 may actually represent a multiprocessor or a distributed processing system; the memory unit 154 may include different levels of cache memory, main memory, hard disks, and remote storage locations; the I/O device 156 may include monitors, keyboards, and the like; and the network interface 158 may include one or more network cards providing one or more wired and/or wireless connections to a network 166. Therefore, a wide range of flexibility is anticipated in the configuration of the computer system 150.

The computer system 150 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 150. The operating system, as well as other instructions (e.g., software instructions for performing the functionality described in previous embodiments) may be stored in the memory unit 154 and executed by the processor 152. For example, the memory unit 154 may include instructions for performing the various methods and control functions disclosed herein.

The network 166 may be a single network or may represent multiple networks, including networks of different types. For example, the network 166 may include one or more cellular links, data packet networks such as the Internet, local area networks (LANs), and/or wide local area networks (WLAN), and/or Public Switched Telephone Networks (PSTNs). Accordingly, many different network types and configurations may be used to couple the computer system 150 to other components of the environment 100 of FIG. 1A and/or to other systems not shown (e.g., remote systems).

Figure 2:
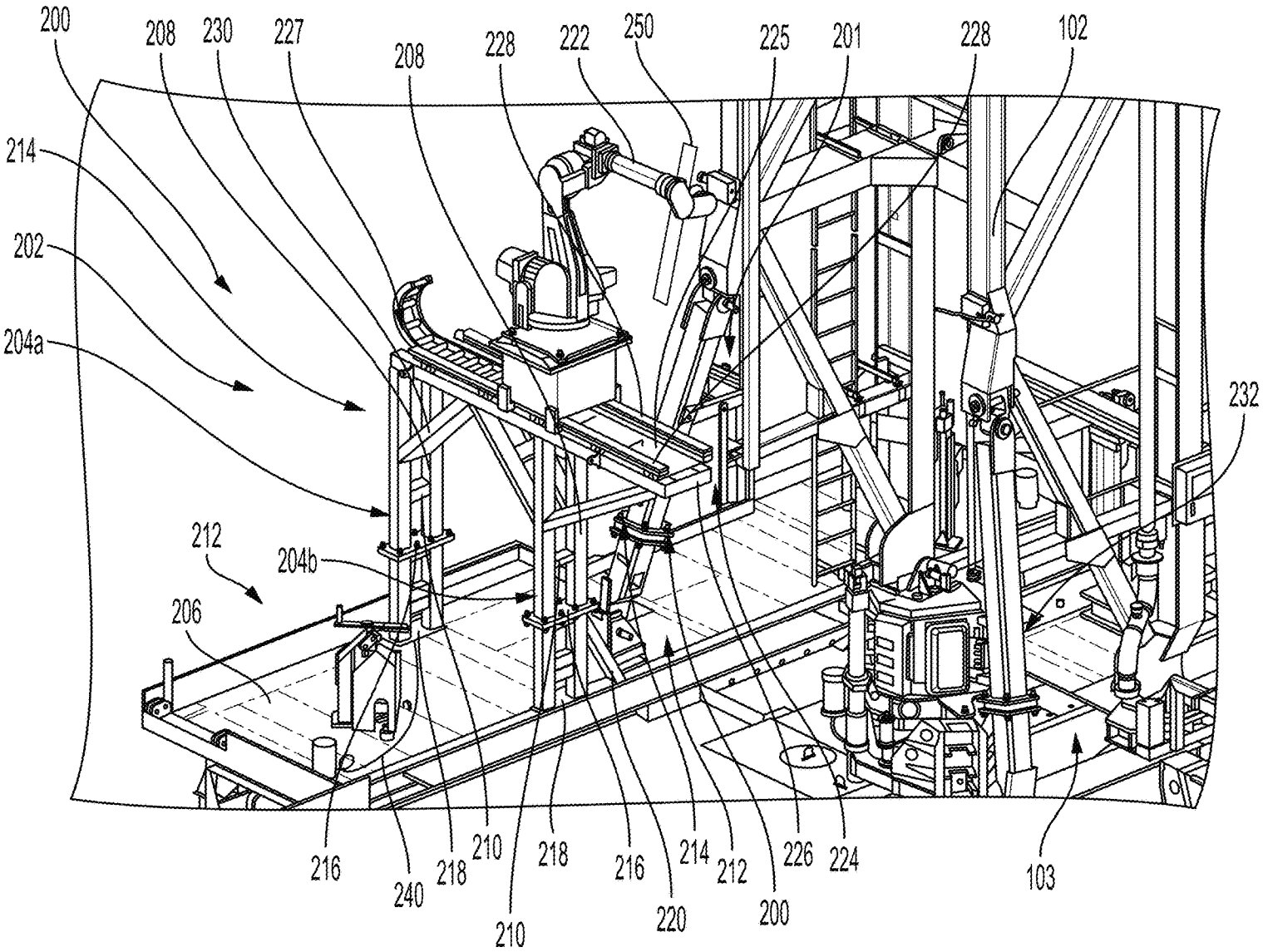
FIG. 2 includes a portion of a drilling rig including an overhead robot track apparatus for elevating a robot of a robot system off the rig floor of a drilling rig, in accordance with some embodiments of the present disclosure.

FIG. 2 illustrates a portion of a drilling rig, for example but not limited to drilling rig 103, including a non-limiting embodiment of an overhead robot track apparatus 200 for elevating a robot 222 of a robot system 201 off the rig floor of the drilling rig 103. The robot 222 may be part of the robot system 201 according to various embodiments. The robot system 201 may include and/or control a load coupling and orientation control apparatus, a remote load coupling and orientation control apparatus, or any other suitable system or apparatus used at a well site, according to various embodiments of the present disclosure.

The overhead robot track apparatus 200 may include a frame assembly 202 having one or more vertical support pillars 204. The overhead robot track apparatus 200 may also include a horizontal track support 226 that is coupled to one or more vertical support pillars 204. In some embodiments, the frame assembly 202 may include the horizontal track support 226. In some embodiments, the horizontal track support 226 extends beyond at least one of the vertical support pillars 204 in a longitudinal direction, for example in a longitudinal direction towards the wellbore. The horizontal track support 226 may support a robot track 225 on which the robot 222 may be positioned. The robot 222 may move laterally along the robot track 225 and thereby laterally with respect to the horizontal track support 226. The robot 222 may include an arm or the like that extends toward and away from the rig floor 206 for moving pipe sections, such as pipe section 250 as shown in FIG. 2, other equipment, or the like, as needed. By elevating the robot 222 off the rig floor 206 of the drilling rig 103, the robot 222 takes up less space on the drilling rig 103 and is out of the way for other equipment and/or workers on the drilling rig 103. When the robot 222 is not needed, the robot 222 is effectively stored out of the way from other operations on the rig floor 206 of the drilling rig 103.

As shown in FIG. 2, the frame assembly 202 includes a distal vertical support pillar 204*a* and a proximate vertical support pillar 204*b*, each of which extends generally upwardly from the rig floor 206. According to some embodiments, the one or more vertical support pillars 204 extend perpendicularly from rig floor 206. Each vertical support pillar 204 may comprise one or more posts 208 and one or more horizontal members 210. In various embodiments, each of the vertical support pillars 204 may include a base portion 212 and an upper portion 214, while in other embodiments, the one or more vertical support pillars 204 may comprise a single unitary element, a single piece, or, while in still some other embodiments, may comprise multiple modular pieces assembled together. In embodiments in which the one or more vertical support pillars 204 comprise a base portion 212 and an upper portion 214, the base portion 212 may be secured to the upper portion 214 via mechanical fasteners (e.g., screws, bolts, welding, etc.), adhesives (glue, etc.), chemical bonding, or other suitable means. For example, the base portion 212 and the upper portion 214 may be removably coupled to one another using mechanical features including one or more of bolts, pins, pins and sockets, mating features (e.g. projections and recesses), locking pins, etc. Again, the base portion 212 and the upper portion 214 may comprise a single unitary element or a single piece, according to various embodiments of the present disclosure. In a non-limiting exemplary embodiment, the base portion 212 may be secured to the upper portion 214 via one or more plates 216, as shown in FIG. 2. The base portion 212 may be couplable to the plate 216 and the upper portion 214 may be couplable to plate 216 in any manner known in the art, such as those described throughout the present disclosure. In other embodiments, no plates 126 are used in the frame assembly 202.

In some embodiments, the base portion 212 may be secured to the drilling rig 103, for example and not limited to, the rig floor 206, such as for example via welding or other suitable means to the I-beams or support structures of the rig. Support structures as used herein may include one or more of an I-beam, an H-beam, a channel beam, a square tubing, a rectangle tubing, a round tubing, a T-bar, etc. In some embodiments, the base portion 212 may be welded to the I-beams or other support structures or built-up sections of the drilling rig. In some embodiments, the base portion 212 and/or the one or more vertical support pillars 204 may be inset into the rig floor 206. In other embodiments, the one or more vertical support pillars 204 may be secured to one or more base plates 218 that are positioned on the rig floor 206.

In some embodiments, the base portion 212 may extend upwards to a height that does not interfere with the road transport height limitations of the drill floor section. For example, and without limitation, in some embodiments the base portion 212 may extend approximately, including but not limited to, about 2 feet, 2.5 feet, 3 feet, 3.5 feet, 4 feet, etc., above a rig floor 206 of a drilling rig such that when the upper portion 214 is uncoupled from the base portion 212, the base portion 212 remaining coupled to the drilling rig is of a suitable height so as to not need to be uncoupled from the drilling rig when the rig is moved. In other words, the base portion 212 may extend above the rig floor 206 to a height equal to or less than the maximum height permitted for transportation of the drilling rig with the base portion secured to the drilling rig. In various embodiments, the robot system 201, and in particular, the horizontal track support 226, may be elevated above the rig floor 206 such that the robot track 225 is elevated above a surface of the rig floor 206. In various embodiments, the horizontal track support 226 may also be positioned below (or lower than) a racking board of the drilling rig 103 (not shown). According to at least some embodiments, the horizontal track support 226 may be elevated above the rig floor 206 but lower than the racking board to an intermediate height location between the rig floor 206 and the racking board. Accordingly, only the areas where the support pillars 204 extend from the rig floor 206 (and any areas for the support legs 220) take up rig floor real estate which collectively may be a much smaller area as compared to the rig floor real estate that the robot track 225 and robot 222 would take up if the robot track 225 and robot 222 were located on the rig floor 206.

In various embodiments, the overhead robot track apparatus 200 may include a horizontal track support 226 for supporting a robot track 225 and a robot 222 as shown in FIG. 2. In some embodiments, the horizontal track support 226 may extend between the two vertical support pillars 204. A robot track 225 may be coupled to the horizontal track support 226, for example but not limited to by bolting the robot track to the horizontal track support 226, though any suitable coupling means may be used (e.g., mechanical fasteners (e.g., screws, bolts, welding, etc.), adhesives (glue, etc.), chemical bonding, or other suitable means for securing the individual modules together to form the frame assembly 202). The robot track 225 may include a pair of rails 228 upon which the robot 222 may move (i.e., forwards, and backwards along the rails). A robot track 225 may be positioned and supported by the horizontal track support 226. The robot track 225 may include one or more of rails 228 (interchangeably referred to herein as tracks) or other features for coupling to the robot 222 of the robot system 201. In some embodiments, the robot 222 may move laterally (i.e., forwards, and backwards) along the rails 228 of the robot track 225. The robot system 201 may include the robot 222 and/or the robot track 225. It is contemplated that the robot system 201 may include more or less components than those described herein. The horizontal track support 226 has a proximate end region 224 and a distal end region 227. The robot 222 may travel along the robot track 225 from the proximate end region 224 and the distal end region 227 for positioning the robot 222 adjacent objects (e.g., pipe sections, such as pipe section 250 as shown in FIG. 2, or the like, not shown) to be moved to different positions on the rig floor 206 by the robot 222. In addition, one or more support legs 220 may extend between the rig floor 206 and at least one of the vertical support pillars 204. In particular, as shown in FIG. 2, in some embodiments, a support leg 220 may extend between the rig floor 206 and a proximate vertical support pillar 204*b* for providing rigidity to the frame assembly 202 to compensate for the force applied to the frame assembly 202 when the robot 222 is positioned at a proximate end region 224 of a horizontal track support 226 of the apparatus 200.

The robot 222, the robot track 225, the horizontal track support 226, and the upper portion 214 may be removed from the drilling rig using a crane/winch or other suitable machinery and set on a skid for transportation or if not needed. The upper portion 214 may be approximately 4 feet to approximately 13 feet in height (or length prior to installation), for example the upper portion 214 may be approximately 4 feet, 5 feet, 6 feet, 7 feet, 8 feet, 9 feet, 10 feet, 11 feet, 12 feet, or 13 feet in height (or length prior to installation). In some embodiments, the base portion 212 may be about 2 feet to approximately 6 feet in length total prior to installation on a drilling rig, for example the base portion 212 may be approximately, including for example but not limited to about, 1 feet, 2 feet, 3 feet, 4 feet, 5 feet, 6 feet, etc., in length total prior to installation on a drilling rig. In some embodiments, the one or more vertical support pillars 204 may extend above the rig floor 206 approximately, including for example but not limited to, about 5 feet, 6 feet, 7 feet, 8 feet, 9 feet, 10 feet, 11 feet, 12 feet, 13 feet, 14 feet, 15 feet, 16 feet, 17 feet, 18 feet, etc., (e.g., extending between about 4 feet and about 8 feet, between about 5 feet and about 10 feet, between about 5 feet and about 7 ft, between about 6 feet and about 16 feet, between about 7 feet and about 15 feet, between about 8 feet and about 14 feet, or other suitable heights above the rig floor 206). In still yet other embodiments of the present disclosure it is contemplated that the total height of the one or more vertical support pillars 204 is greater than or equal to 16 feet above the rig floor 206 of the drilling rig 103 or less than or equal to 5 feet above the rig floor 206 while remaining above the rig floor 206. Accordingly, the horizontal track support 226 may extend above the rig floor 206 approximately, including for example but not limited, to 8 feet, 9 feet, 10 feet, 11 feet, 12 feet, 13 feet, 14 feet, 15 feet, 16 feet, etc., such that the likelihood of a worker hitting their head is reduced. In various embodiments, the robot system 201, and in particular, the horizontal track support 226, may be elevated above the rig floor 206 but below (or lower than) a racking board of the drilling rig 103 (not shown). For example, the horizontal track support 226 may be elevated above the rig floor 206 but lower than the racking board to an intermediate height location between the rig floor 206 and the racking board.

Though in the embodiment of the present disclosure depicted in FIG. 2 the vertical support pillars 204 each comprise a pair of posts 208 and a plurality of horizontal members 210 extending between the pair of posts 208, in other embodiments the vertical support pillars 204 may comprise more or fewer posts 208 (e.g., one post or three posts) and/or horizontal members 210 (e.g., zero, one, or six). In some embodiments, each vertical support pillar 204 may comprise a single column, for example, in some embodiments, each vertical support pillar 204 may comprise a single steel I-beam. The size of the posts 208 defining the vertical support pillar 204 may be selected based on the number of posts 208 being used and the material of the posts 208 to provide for sufficient support when the robot 222 is positioned on the robot track 225 coupled to the apparatus 200.

In some embodiments, wiring and/or other service connections 240 for coupling the robot 222 to a power source, a computing device, hydraulics, pneumatics, or any other machinery, may run down one or more of the vertical support pillars 204. For example, the one or more vertical support pillars 204 may have a cut-out, a recess, or may have an interior hollow region which may receive the service lines running to and/or from the robot 222.

The height of the vertical support pillars 204 may improve the reach of the robot 222 by positioning the robot 222 closer to the derrick 102 for grabbing a pipe section (e.g., an angled pipe). By raising the robot 222 above the rig floor 206 via the apparatus 200, the reach of the robot 222 may be improved such that less reach is required to grab onto the pipe section (not shown). In addition, as shown in FIG. 2, by raising the robot 222 off the rig floor 206 of the drilling rig, more rig floor space is provided, and the robot 222 is less likely to be damaged. For example, the likelihood of a collision between the robot 222 and heavy machinery or materials used on the rig floor 206 may be reduced with the robot 222 elevated off the rig floor 206. In addition, this configuration avoids the risk of injury to a worker on the rig floor 206 from the robot 222 or its operations. In various embodiments, the robot system 201, and in particular, the horizontal track support 226, may be elevated above the rig floor 206 but below (or lower than) a racking board of the drilling rig 103 (not shown). For example, the horizontal track support 226 may be elevated above the rig floor 206 but lower than the racking board to an intermediate height location between the rig floor 206 and the racking board.

In some embodiments, for example as shown in FIG. 2, the horizontal track support 226 may extend beyond an end of at least one vertical support pillar 204. By extending the horizontal track support 226 beyond the end of at least one vertical support pillar 204, the reach of the robot 222 may be increased which may improve the ability of the robot 222 to grab a section of pipe.

In some embodiments, the frame assembly 202 of the overhead robot track apparatus 200 may also include one or more cantilever supports 230 which may extend between at least one vertical support pillar 204 and the horizontal track support 226. The cantilever support(s) 230 may provide additional support for the weight of the robot 222 on the horizontal track support 226. For example, at least one cantilever support 230 may extend between a vertical support pillar 204 and a proximate end region 224 (end closest to the wellbore 232) of the horizontal track support 226 (or a region of the horizontal track support 226 proximate to the wellbore 232) for providing support when the robot 222 is positioned at the proximate end region 224 of the horizontal track support 226. In the embodiment depicted in FIG. 2, three cantilever supports 230 are provided. A first cantilever support 230 extends between the distal vertical support pillar 204*a* (vertical support positioned farthest from the wellbore 232) and the horizontal track support 226, a second cantilever support 230 extends between a first side of the proximate vertical support pillar 204*b* (vertical support positioned closest to the wellbore 232) and the horizontal track support 226, while a third cantilever support extends between a second side of the proximate vertical support pillar 204*b* and the horizontal track support 226. Though three cantilever supports 230 are depicted in FIG. 2, more or fewer cantilever supports 230 may be used. Moreover, different placement of the cantilever supports 230 are contemplated. For example, the cantilever support 230 may extend between a support pillar 204 and a region of the horizontal track support 226 located proximate to the wellbore 232. As shown in FIG. 2, the position of the cantilever supports 230 may be such that a suitable height clearance is provided below the cantilever supports 230 for workers on the drilling rig 103. For example, the cantilever supports 230 can extend from a location on the vertical support pillars 204 that provides for suitable height clearance for the workers on the drilling rig 103 (e.g., at a height of 6 feet or greater). This approach minimizes the risk that a worker will bump their head on the frame assembly 202. In various embodiments, the robot system 201, and in particular, the horizontal track support 226, may be elevated above the rig floor 206 but below (or lower than) a racking board of the drilling rig 103 (not shown). For example, the horizontal track support 226 may be elevated above the rig floor 206 but lower than the racking board to an intermediate height location between the rig floor 206 and the racking board.

One or more of the cantilever supports 230 may include one or more posts 208 and one or more horizontal members 210 extending between the pair of posts 208, though in other embodiments one or more of the cantilever supports 230 may comprise more or fewer posts 208 (e.g., one post or three posts). As the robot 222 may move laterally along the robot track 225, the cantilever support(s) 230 may provide additional structural support to the horizontal track support 226, in particular, when the robot 222 is positioned at the proximate end region 224 of the robot track 225.

Robot systems referenced herein may include one or more robots, for example, but not limited to, robot 222. Generally, the present disclosure contemplates any robot that may be used on a drilling rig, for example robots that may be used for grabbing, tailing, racking, running in, pulling out, or otherwise moving pipe or other materials on a drilling rig. For example, robot 222 may be a robot with an arm, handle, grip, or other extension member for gripping a tubular such as a drill pipe (e.g., such as, but not limited to, pipe section 250 as shown in FIG. 2). In one exemplary embodiment, the robot 222 may include an arm for gripping a tubular or the like, as shown in FIG. 2. The present disclosure also contemplates robots, e.g., robot 222, that include a hex-grip, slips, or other features.

Figure 3:
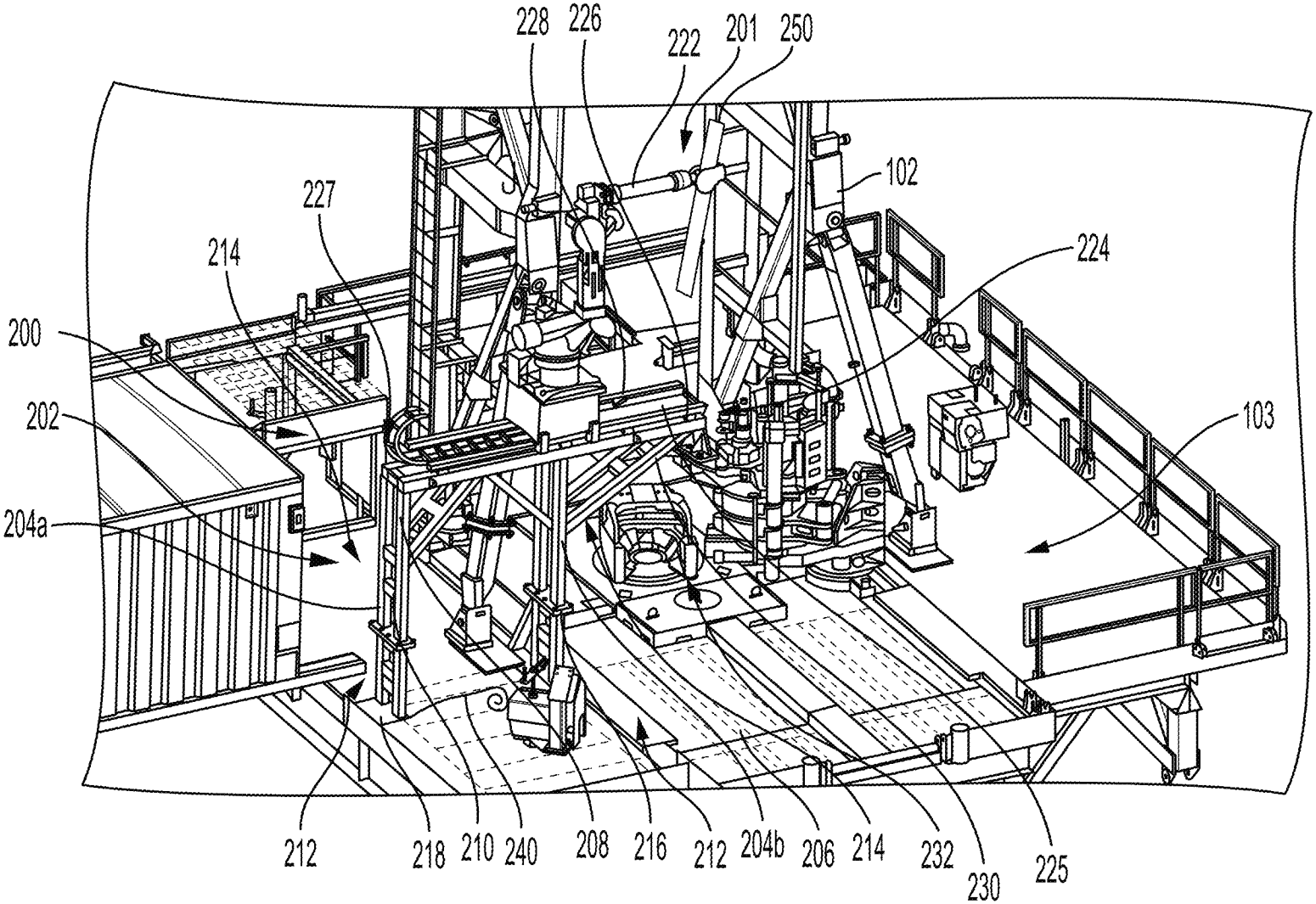
FIG. 3 includes another view of the overhead robot track apparatus for elevating a robot of a robot system off the rig floor as shown in FIG. 2, in accordance with some embodiments of the present disclosure.

FIG. 3 includes another view of the drilling rig 103 depicting the overhead robot track apparatus 200 for elevating a robot 222 of a robot system 201 off the rig floor 206 as shown in FIG. 2. As shown in FIG. 3, the frame assembly 202 supporting the robot 222 may be positioned relative to the wellbore 232 such that the robot 222 may translate along the robot track 225 toward the wellbore 232 for positioning pipe sections or the like, such as, but not limited to, pipe section 250, during tripping in/out, and away from the wellbore 232 when not in use. In various embodiments, the robot 222 may translate the pipe section 250 between a first position (as shown in FIG. 2) and a second position (as shown in FIG. 3) and vice versa.

It should be noted that the foregoing discussion focusses on the overhead robot track apparatus 200 being coupled to support structures attached to the rig floor but according to embodiments of the present innovation the overhead robot track apparatus 200 may be coupled to other elements of the drilling rig in lieu of or in addition to the support structure, including but not limited to the mast, the cabin or other drilling rig elements. In some embodiments, the support structures may be coupled to other elements of the drilling rig in addition to or in lieu of the rig floor, including but not limited to the mast, cabin or other drilling rig elements. According to various embodiments, the horizontal track support 226 having the robot track 225 may be pinned or otherwise removably secured to or supported by a mast or other structural component of the drilling rig 103. For example, the horizontal track support 226 may be removably coupled to the drilling cabin (e.g., drilling control room) or the like. In some embodiments, a support member of the frame assembly 202 may be pinned or otherwise removably secured to the mast or other structural component of the drilling rig 103.

Various embodiments contemplated by the present disclosure include one or more robots including any robot that may be used on a drilling rig, for example robots that may be used for grabbing, tailing, racking, running in, pulling out, or otherwise moving pipe or other materials on a drilling rig. In at least some embodiments, the present disclosure further contemplates one or more overhead robot track apparatuses as described herein, for example and not limited to, the overhead robot track apparatus 200. For example, one or more frame assemblies described herein, for example and not limited to, frame assembly 202, may be spaced apart along the floor of the drilling rig. Accordingly, a horizontal track support (or a plurality of horizontal track supports) described herein, for example and not limited to horizontal track support 226, may be used to transport and operate robots above the rig floor. For example, a horizontal track supports may be usable with a plurality of frame assemblies. The modular characteristic of the frame assemblies and horizontal track supports enable multi-directional capabilities for transporting and operating the robots.

Figure 4:
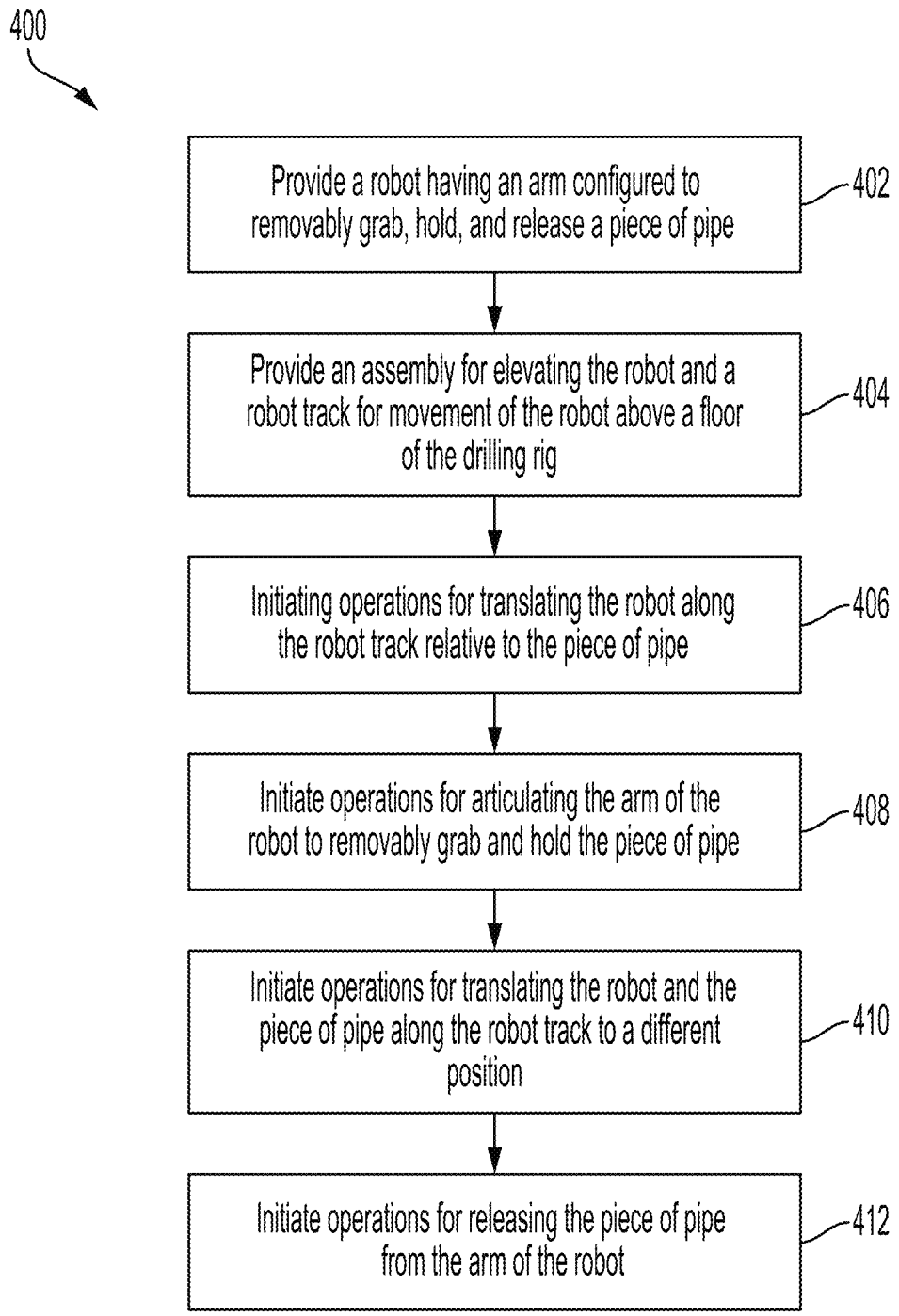
FIG. 4 is a flowchart of a method for handling a pipe on a drilling rig, in accordance with some embodiments of the present disclosure.

FIG. 4 is a flowchart of a non-limiting exemplary method 400 for handling a pipe on a drilling rig. Method 400 may be used in combination with any of the embodiments described herein. For example, method 400 may use an overhead robot track apparatus as described herein, for example and not limited to, the overhead robot track apparatus 200, for handling a pipe on a drilling rig. Method 400 may include step 402. Step 402 may include providing a robot having an arm configured to removably grab, hold, and release a piece of pipe. The robot may be coupled to rails of a robot track for movement of the robot, as described above. For example, the robot may be coupled to the robot track using rails or the like.

Step 404 may further include providing an assembly for elevating the robot and the robot track above a rig floor of the drilling rig. The assembly may include various features of the frame assembly 202 described above. According to various embodiments, the assembly elevates the robot above workers and other heavy machinery on the rig floor for reducing the likelihood of injury to workers or damage to the robot system during operation of the robot or when the robot is not in use. In various embodiments, the assembly and/or the robot may be elevated above the rig floor but below (or lower than) a racking board of the drilling rig 103 (not shown).

Step 406 may include initiating operations for translating the robot along the robot track relative to the piece of pipe. For example, a system including the robot and the frame assembly, for example but not limited to, the robot 222 and the frame assembly 202, may further include a computer system (or controller or control system) for operating various operations of the system. The computer system may include various features computer system (or controller or control system) 150 of FIG. 1B described herein. An operator may instruct the computer system to cause the robot to travel along the robot track closer to or farther from the piece of pipe, or other components, as needed.

Step 408 may further include initiating operations for articulating the arm of the robot to removably grab and hold the piece of pipe, such as, but not limited to, pipe section 250. For example, the robot may be configured to grab and hold the piece of pipe using grips, slips, or the like.

Step 410 may optionally include initiation operations translating the robot and the piece of pipe along the robot track to a different position. In at least some embodiments, it may be desirable for the robot to hold and move the piece of pipe to another location on the drilling rig floor. Step 412 may include initiating operations for releasing the piece of pipe from the arm of the robot at the different position. Various steps described herein may be individually initiated by an operator of the system or one or more of the steps may be automated.

In various embodiments, the control system may be wirelessly coupled to the robot system for initiating operations of the robot system. For example, the operations may be transmitted to the robot system via a wireless connection such as Bluetooth or the like. The control system may communicate via a wired and/or wireless connection. Furthermore, the control system may receive instructions from an operator via either a wired or wireless connection. A control system may be used to coordinate the operation of a robot system on an overhead track apparatus according to aspects of the present disclosure with a robot (or apparatus) for moving tubular rotary slips, for example the tubular rotary slips apparatus disclosed in U.S. patent application Ser. No. 18/592,060, filed Feb. 29, 2024, the entirety of which is incorporated herein by reference. For example, the control system may coordinate the movement of a tubular rotary slips apparatus and the robot system on the overhead track apparatus for coordinating the movement of tubulars about the drilling rig.

Furthermore, relative terms such as, "lower", "upper", "up", "down", "above", "below," "downward," "upward," "upwardly" and the like are used herein to indicate directions and locations as they apply to the appended drawings and will not be construed as limiting the invention and features thereof to particular arrangements or orientations.

In some embodiments of the present disclosure, more or fewer steps may be performed from the exemplary methods and operations described above. For example, although the discussion above has been primarily focused on making-up and breaking-out drill pipe, many of the disclosed steps and same equipment may be used for making-up or breaking-out a casing. In addition, the methods and operations described herein may also be performed in reverse for breaking-out a drill pipe or casing.

The subject matter of embodiments of this patent is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

It should be noted that references to a "stand" or a single "piece" of pipe should be understood to include both situations with respect to the methods and apparatus described herein. The references to a piece of pipe or to a stand are intended to be illustrative examples and not limiting.

Different arrangements of the components depicted in the drawings or described above, as well as components and steps not shown or described, are possible. Similarly, some features and subcombinations are useful and may be employed without reference to other features and subcombinations. Embodiments of the disclosure have been described for illustrative and not restrictive purposes, and alternative embodiments will become apparent to readers of this patent. Accordingly, the present disclosure is not limited to the embodiments described above or depicted in the drawings, and various embodiments and modifications can be made without departing from the scope of the claims below.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilize the invention in various embodiments and with various modifications as are suited to the particular use contemplated. Therefore, further modifications or improvements may be incorporated without departing from the scope of the invention herein intended.

We claim:

1. A drilling rig assembly comprising:

a robot system further comprising a robot and a robot track for movement of a position of the robot;

a frame assembly couplable to a drilling rig for positioning the robot system above a floor of the drilling rig, the frame assembly comprising:

a first support pillar extending upwardly from a floor of the drilling rig;

a horizontal track support coupled to the robot track and coupled to the first support pillar; and a cantilever support extending between the first support pillar and the horizontal track support, wherein the robot track comprises a plurality of rails that couple to the robot such that the robot may move along a length of the robot track.

2. The drilling rig assembly of claim 1, wherein the first support pillar comprises a pair of posts and one or more horizontal members extending between the pair of posts.

3. The drilling rig assembly of claim 1, wherein the robot of the robot system comprises an arm for gripping a tubular.

4. The drilling rig assembly of claim 1, wherein the horizontal track support extends beyond the first support pillar.

5. The drilling rig assembly of claim 1, wherein the cantilever support extends between the first support pillar and a region of the horizontal track support positioned proximate to a wellbore.

6. The drilling rig assembly of claim 1, wherein the first support pillar extends vertically upwards from the floor of the drilling rig.

7. The drilling rig assembly of claim 1, wherein the frame assembly further comprises a second support pillar extending upwardly from the floor of the drilling rig.

8. An overhead robot track apparatus comprising:

a frame assembly couplable to a drilling rig for positioning a robot above a floor of the drilling rig, the frame assembly comprising:

a first vertical support pillar;

a second vertical support pillar;

a horizontal track support sized and shaped to couple to a robot track, the horizontal track support coupled to each of the first vertical support pillar and the second vertical support pillar; and at least one cantilever support extending between the first vertical support pillar and the horizontal track support, wherein each of the first vertical support pillar and second vertical support pillar comprise a base portion that is removably couplable to an upper portion.

9. The overhead robot track apparatus of claim 8, wherein the first vertical support pillar comprises a pair of posts and one or more horizontal members extending between the pair of posts.

10. The overhead robot track apparatus of claim 8, wherein the horizontal track support is elevated at a height above the rig floor but lower than a racking board of the drilling rig.

11. The overhead robot track apparatus of claim 8, wherein the horizontal track support extends beyond at least one of the first vertical support pillar and the second vertical support pillar, and wherein the at least one cantilever support extends between a portion of the horizontal track support that extends beyond the at least one of the first vertical support pillar and the second vertical support pillar.

12. The overhead robot track apparatus of claim 8, wherein the horizontal track support is removably couplable to a mast of the drilling rig.

13. The overhead robot track apparatus of claim 12, wherein the base portion is secured to a support structure and to the drilling rig.

14. The overhead robot track apparatus of claim 13, wherein the support structure comprises one or more of an I-beam, an H-beam, a channel beam, a square tubing, a round tubing, or a rectangular tubing.

15. The overhead robot track apparatus of claim 8, wherein the first vertical support pillar extends at least 5 feet above the floor of the drilling rig.

16. A method for handling a pipe on a drilling rig, the method comprising:

providing a robot having an arm configured to removably grasp and release a piece of pipe, wherein the robot is coupled to a robot track for movement of the robot;

providing an assembly for elevating the robot and the robot track above a floor of the drilling rig, wherein the assembly comprises:

a first support pillar extending upwardly from a floor of the drilling rig;

a second support pillar extending upwardly from the floor of the drilling rig;

a horizontal track support coupled to the robot track and coupled to the first support pillar and the second support pillar; and a cantilever support extending between the first support pillar and the horizontal track support; and positioning the robot along the robot track at a first position over an upper section of drill pipe;

extending the arm of the robot toward the upper section of drill pipe;

grasping the upper section of drill pipe;

translating the robot and the upper section of drill pipe along the robot track to a second position over a lower section of drill pipe; and releasing the upper section of drill pipe at the second position for making up a drill pipe.

17. The method for handling a pipe on a drilling rig of claim 16, wherein the horizontal track support is removably couplable to a mast of the drilling rig.

18. The method for handling a pipe on a drilling rig of claim 16, wherein the horizontal track support is elevated at a height above the rig floor but lower than a racking board of the drilling rig.

19. The method for handling a pipe on a drilling rig of claim 16, wherein the horizontal track support extends beyond at least one of the first support pillar and the second support pillar.

20. The method for handling a pipe on a drilling rig of claim 19, wherein the cantilever support extends between the first support pillar and a region of the horizontal track support positioned proximate to a wellbore.

* * * * *